US006122927A

United States Patent [19]

Moore

[11] Patent Number: 6,122,927

[45] Date of Patent: Sep. 26, 2000

[54] ICE CUBE GUIDE FOR ICE APPARATUS

[75] Inventor: Michael Moore, Louisville, Ky.

[73] Assignee: Hoshizaki America, Inc., Peachtree City, Ga.

[21] Appl. No.: 09/313,976

[22] Filed: May 19, 1999

[51] Int. Cl.[7] ..... F25C 1/12

[52] U.S. Cl. ..... 62/347; 62/348

[58] Field of Search ..... 62/73, 74, 344, 62/347, 348, 352

[56] References Cited

U.S. PATENT DOCUMENTS

| | | | |
|---|---|---|---|
| 3,430,452 | 3/1969 | Dedricks et al. | 62/138 |
| 4,459,824 | 7/1984 | Krueger | 62/347 |
| 4,505,130 | 3/1985 | Hibino et al. | 62/347 |
| 5,182,925 | 2/1993 | Alvarez et al. | 62/347 |
| 5,426,954 | 6/1995 | Furukawa | 62/347 |

*Primary Examiner*—William E. Tapolcai
*Attorney, Agent, or Firm*—Arent Fox Kintner Plotkin & Kahn

[57] ABSTRACT

An ice guide plate with a trapezoidal main body joined to a right triangular side plate by a joining plate. The joining plate has only two lateral water recovery slots in a lower section thereof. A pair of drip ridges are provided on the back of the joining plate as continuations of two reinforcing ribs of the main body and the side plate. A valley gutter slot is provided along the lower edge of the joining plates and extends up into the main body and the adjacent side plate as well.

8 Claims, 4 Drawing Sheets

ICE CUBE GUIDE FOR ICE APPARATUS

BACKGROUND OF THE INVENTION

The present invention relates to an ice piece manufacturing apparatus having an improved guide plate for guiding ice pieces made on a manufacturing plate to an ice bin. More specifically, the invention relates to an ice piece manufacturing apparatus in which a guide plate is directly arranged below an ice manufacturing plate with the guide plate inclined toward the ice bin. The guide plate serves to separate the ice pieces as they are manufactured from any water.

Various apparatus have been proposed for manufacturing ice pieces. In such apparatuses, ice pieces are generally manufactured as follows: at first, when a cooling device is driven, a cooling medium is circulated in an ice manufacturing plate to cool down the manufacturing plate. Water used for manufacturing ice pieces is then provided from a water tank to the cooled manufacturing plate through a water providing pump. The water provided to the manufacturing plate is sprinkled over an upper surface of the manufacturing plate. The sprinkled water is gradually frozen and ice pieces are formed on the outer surface of the manufacturing plate. After manufacturing of the ice pieces mentioned above is finished, the ice pieces formed on the surface of the manufacturing plate are released from the surface by flowing releasing water onto the manufacturing plate which is utilized for releasing the ice pieces from the surface of the manufacturing plate. The released ice pieces are then guided toward an ice bin by a guide plate. Water that reaches the guide plate flows through holes therein to be caught and recycled.

Conventional guide plates installed in a conventional ice piece manufacturing apparatus are shown and described in U.S. Pat. Nos. 5,426,954 and 4,505,130, hereby incorporated by reference. These conventional guide plates are generally rectangular and are installed between the water tank and the guide plate in the conventional ice piece manufacturing apparatus. As shown in the above patents, these plates have water recovery slits or slots in them to enable water to flow directly through while diverting the ice pieces off to the side into the ice bin. The plates cover the water tank. Upstanding side flange members are provided for attachment to the remainder of the apparatus and to direct the ice pieces solely towards the ice bin.

A guide plate 1 is known having a irregular trapezoidal main body 10. A partial view of such a plate 1 is shown in FIGS. 5 and 6. The main body 10 has an long laterally extending edge 12 and a shorter parallel laterally extending edge 14. One side edge (not shown) is perpendicular to the parallel laterally extending edges 12,14. The other side edge 16 is angled at about a 450 angle to the parallel laterally extending edges 12, 14. The angled side edge 16 is joined by a triangular side plate 20. The general shape of the triangular side plate 20 is a right triangle. The angled side edge 16 of the main body 10 joins the side plate 20 along the hypotenuse 24 of the side plate 20. This juncture can be called a hip. The hip is defined by a flat joining plate section 30 which extends in parallel with the angle side edge 16 and the hypotenuse 24 of the triangular side plate 20. As shown in the plan view of FIG. 5, the angled side plate 20 has a plurality of water recovery slots 42 which parallel the hypotenuse 24 of the plate 20. The main body 10 has a plurality of water recovery slots 44 which are aligned perpendicular to the laterally extending edges 12,14. The flat joining plate 30 has a plurality of longitudinally extending water recovery slots 46. The underside of the angled side plate 20 as shown in FIG. 6 is provided with reinforcing ribs 52 molded therein extending in parallel with the two perpendicular sides 22 of the triangular side plate 20. The underside of the main body 10 is provided with reinforcing ribs 54 molded therein extending in parallel with the laterally extending edges 12,14 and perpendicular thereto. The underside of the joining plate 30 is bare of any reinforcing ribs.

Several difficulties have been encountered with the above design for a guide plate. There is a tendency for ice pieces to be caught in the lowermost two longitudinally extending water recovery slots in the joining plate. This causes interference with the travel of any following ice pieces sliding down toward the ice bin. In addition, a stream of water flowing on the under side of the joining plate, probably caused by surface tension, causes water to flow over the edge of the water tank. Still further, a stream of water builds up in the lower corner where the faces of the angled side plate, the joining plate, and the main body meet.

SUMMARY OF THE INVENTION

Accordingly, it is an object of the present invention to overcome the above problems and to provide an ice piece manufacturing apparatus in which a guide plate for guiding ice pieces is directly arranged below an ice manufacturing plate in an inclined state where the guide plate directs the ice pieces toward an ice bin in the apparatus, providing a simple construction which avoids the catching of ice pieces on the guide plate and precludes water loss. In this manner, the ice pieces dropped from the manufacturing plate can be guided into the ice bin in a smooth manner.

In order to accomplish the above object, the present invention provides an ice guide plate for an ice piece manufacturing apparatus including an apparatus body; a cooling unit arranged in the apparatus body; an ice manufacturing member for manufacturing ice pieces by being cooled down through the cooling unit; a retaining member for retaining the ice manufacturing member in the apparatus body; an ice bin for storing the ice pieces manufactured by the ice manufacturing member, the ice bin being positioned near the ice manufacturing member; the ice guide plate guiding the ice pieces manufactured by the ice manufacturing member into the ice bin. The ice The present invention in one aspect is an ice guide plate comprising an irregular trapezoidal main body having a face, an underside, a long laterally extending edge, a short parallel laterally extending edge, a perpendicular side edge and an angled side edge, a triangular side plate in the form of a right triangle and having a face and an underside, the angled side edge of the main body joining the side plate along a hypotenuse of the side plate, and a flat joining plate extending in parallel with and joining the angle side edge of the main body and the hypotenuse of the triangular side plate defining a valley floor, the joining plate having a face and an underside. The angled side plate has a plurality of water recovery slots which parallel the hypotenuse of the plate. The main body has a plurality of water recovery slots which are aligned perpendicular to the laterally extending edges. The flat joining plate has a plurality of longitudinally extending water recovery slots along an upper portion of the valley floor and two laterally extending water recovery slots in a lower portion of the valley floor.

A second aspect of the invention is an ice guide plate as above wherein a valley gutter slot is provided extending laterally across a lower end of the valley floor and extending along the short laterally extending edge of the main body and along one of the side edges of the angled side plate.

A third aspect of the invention is an ice guide plate comprising an irregular trapezoidal main body having a face, an underside, a long laterally extending edge, a short parallel laterally extending edge, a perpendicular side edge, and an angled side edge, a triangular side plates in the form of a right triangle and having a face and an underside, the angled side edge of the main body joining the side plate along a hypotenuse of the side plate, and a flat joining plate which extends in parallel with and joins one angle side edge of the main body and the hypotenuse of the triangular side plate defining a valley floor, each joining plate having a face and an underside, wherein the underside of the joining plate has a pair of downwardly extending drip ridges which extend diagonally, laterally of a longitudinal axis of the joining plate section.

A fourth aspect of the invention is an ice guide plate as above, wherein the underside of the angled side plate is provided with reinforcing ribs molded therein extending in parallel with the two perpendicular sides of the triangle, the underside of the main body is provided with reinforcing ribs molded therein extending in parallel with the laterally extending edges and perpendicular thereto, and the drip ridges are formed as extensions of and joining two of the reinforcing ribs of the adjacent angled side plate and two of the reinforcing ribs of the main body.

According to the present invention, the ice manufacturing member arranged in the apparatus body through the retaining member is cooled down by the cooling unit and then the ice pieces are manufactured on the ice manufacturing member. The thus manufactured ice pieces are released from the ice manufacturing member and thereafter are guided by the guide plate and stored in the ice bin. Because of the positioning of the two laterally extending water recovery slots in the lower portion of the valley floor defined by the joining plate and because the slots extend primarily laterally, ice pieces being guided by the angled side plate and by the inclined main body are no longer trapped along the valley floor and continue to slide smoothly down to the ice bin. Further water is enabled to freely flow into the water tank below.

Because of the valley gutter slot, water cannot accumulate at the base of the valley floor and overflow outside of the water tank. The extension of the valley gutter slot up into both the angled side plate and the main body assists in directing the water flow down into the water tank without the necessity of a lower lip on the plate.

Because of the pair of downwardly extending drip ridges on the underside of the joining plate, water flow is directed downwardly into the water tank and is no longer permitted by surface tension adhesion to flow along the entire underside of the joining plate and outside of the water tank.

By making the drip ridges formed as extensions of and joining two of the reinforcing ribs of the adjacent angled side plate and two of the reinforcing ribs of the main body, surface tension adhesion flow of water is prevented and lateral strength reinforcement is added to the joining plate.

BRIEF DESCRIPTION OF THE DRAWINGS

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

DETAILED DESCRIPTION OF THE PREFERRED EMBODIMENTS

A detailed description of the preferred embodiment according to the present invention will be given referring to FIGS. 1–4.

Figure 1:
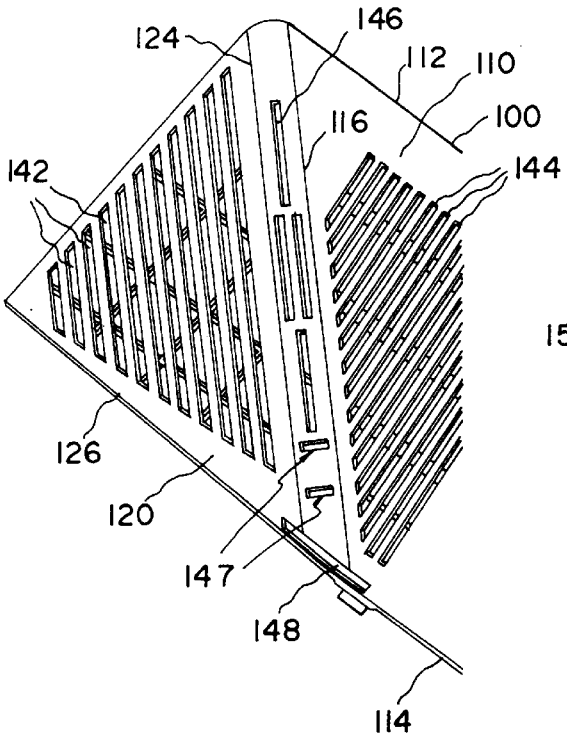
FIG. 1 is a partial top plan view of an ice piece guide plate according to one embodiment of the present invention.
Figure 2:
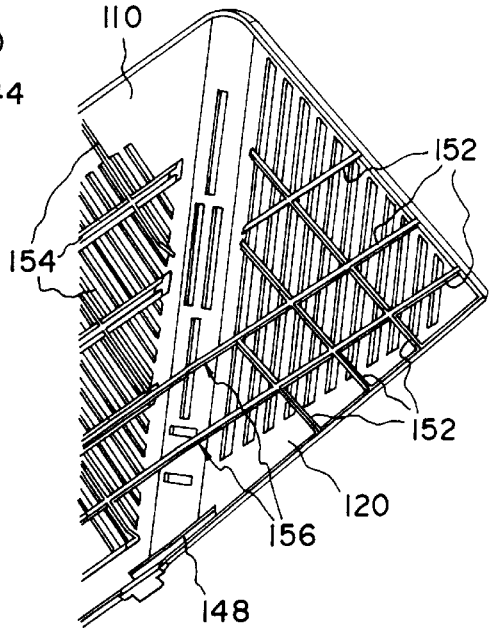
FIG. 2 is a partial bottom view of the portion of FIG. 1.
Figure 3:
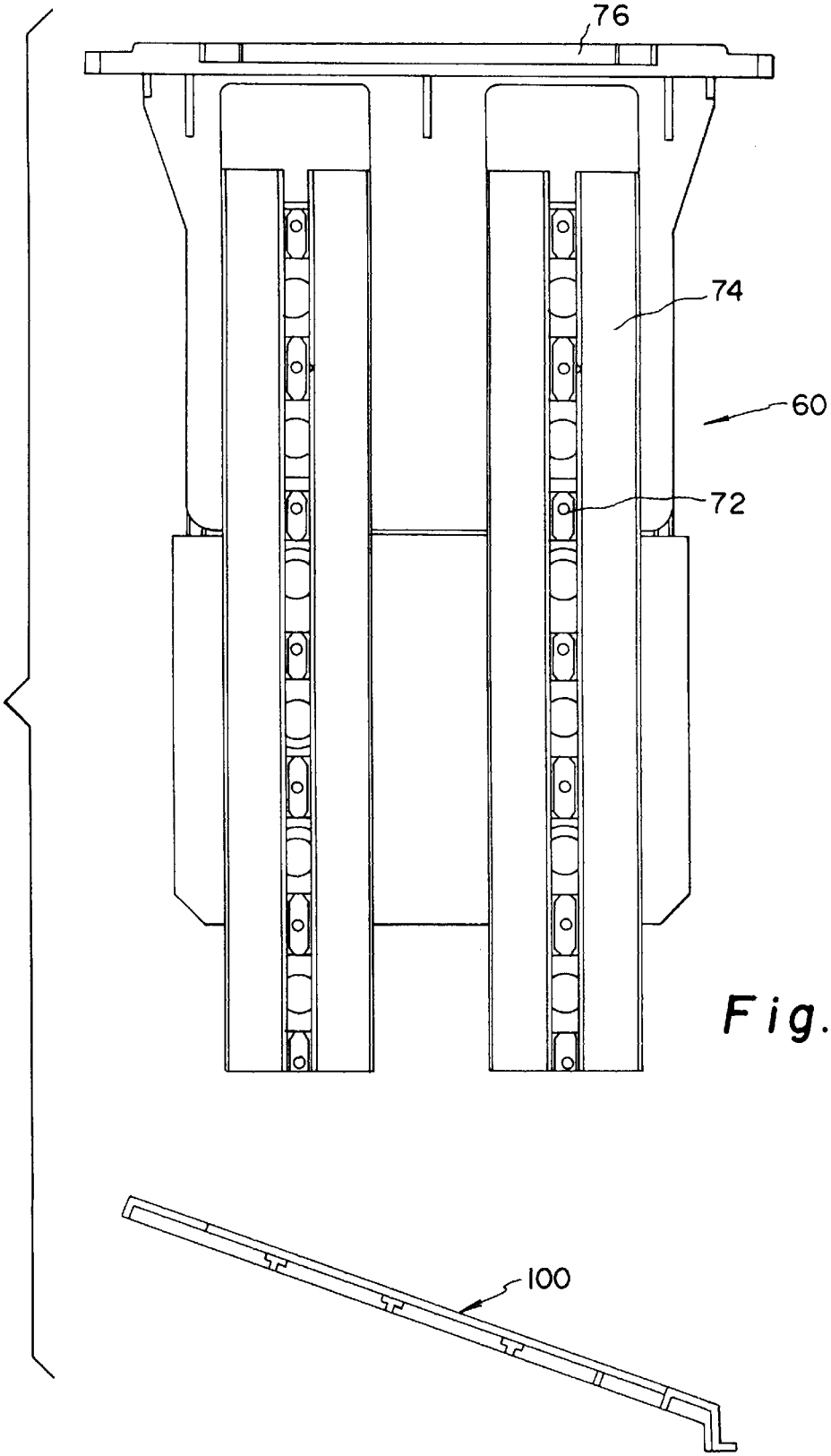
FIG. 3 is a cross sectional view of an ice piece manufacturing apparatus using the guide plate of the present invention taken along line 3—3 in FIG. 4.
Figure 4:
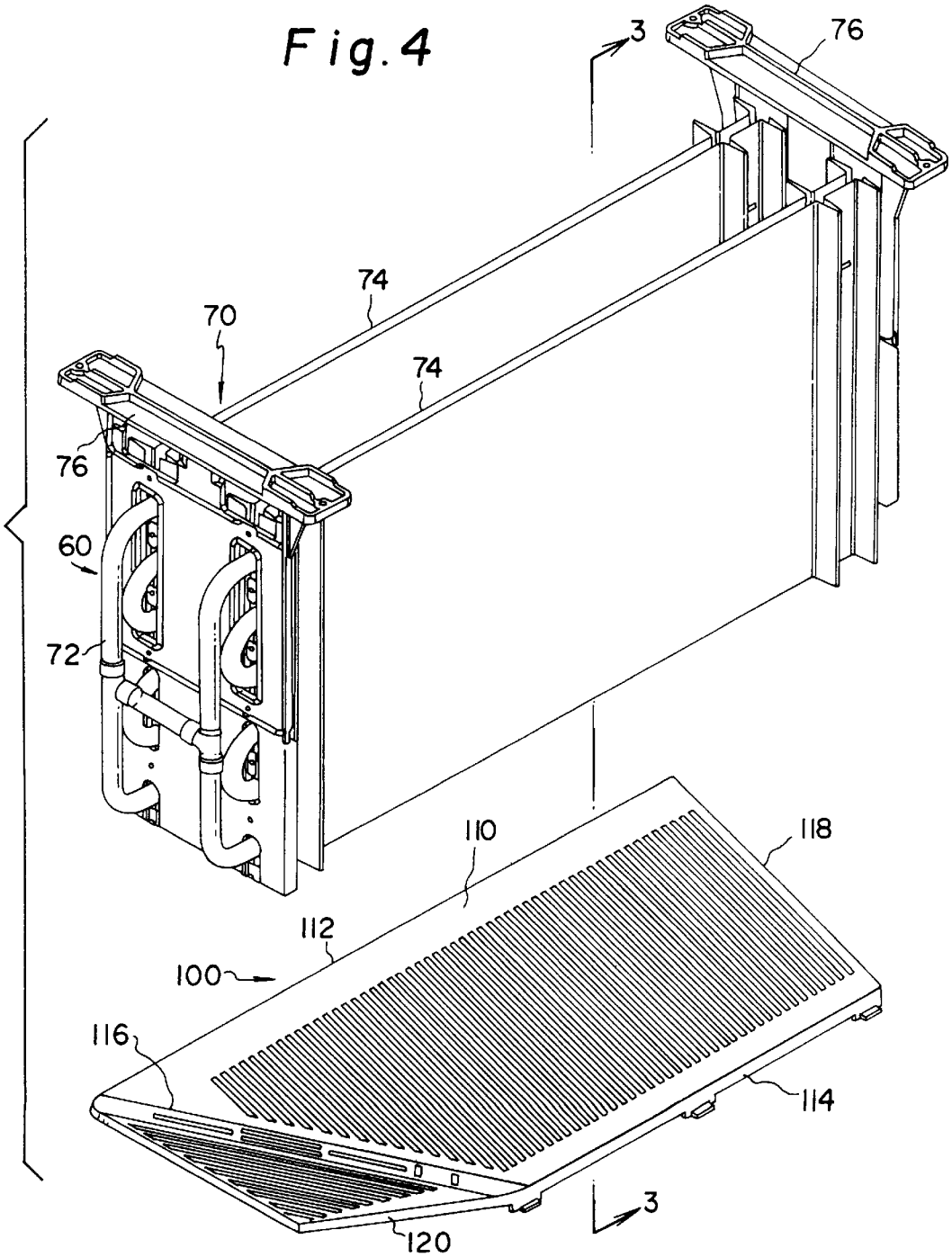
FIG. 4 is a partial perspective view of the an ice piece manufacturing apparatus using the guide plate of the present invention.
Figure 5:
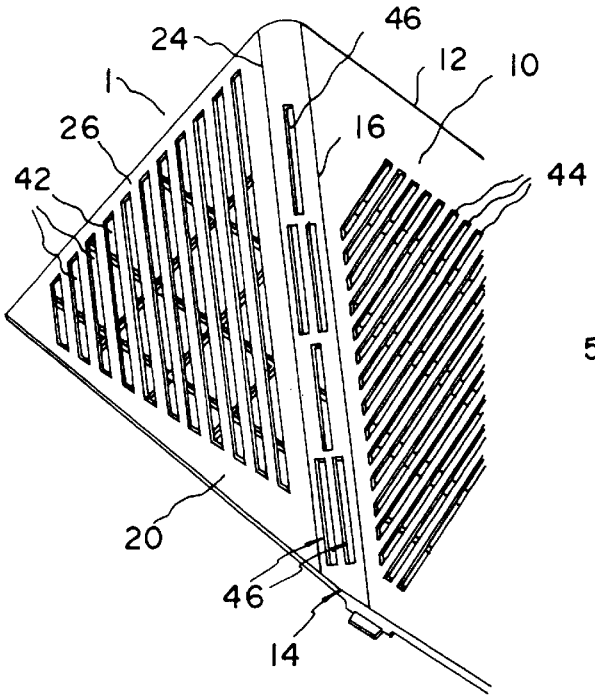
FIG. 5 is a partial top plan view of a conventional ice piece guide plate.
Figure 6:
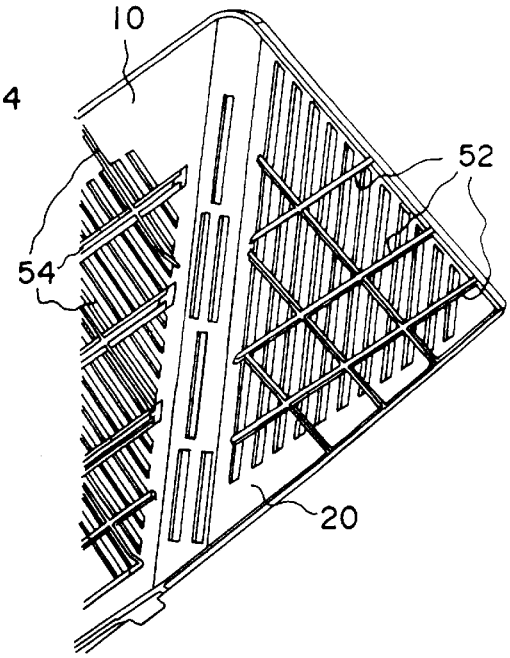
FIG. 6 is a partial bottom view of the portion of FIG. 5.

As partially shown in FIGS. 3 and 4 and as would be evident to a person of ordinary skill in this art, the present invention is an ice guide plate for an ice piece manufacturing apparatus including an apparatus body 70. A cooling unit 72 is arranged in the apparatus body. An ice manufacturing member 74 is provided for manufacturing ice pieces by being cooled down through the cooling unit 72. Retaining members 76 are provided for retaining the ice manufacturing member 74 in the apparatus body 72. An ice bin (not shown) is provided for storing the ice pieces manufactured by the ice manufacturing member 74, the ice bin being positioned near and generally below the ice manufacturing member 74. The ice guide plate 100 is provided for guiding the ice pieces manufactured by the ice manufacturing member into the ice bin.

The present invention in one aspect is an ice guide plate 100 comprising an irregular trapezoidal main body 110 having a face, an underside, a long laterally extending edge 112, a short parallel laterally extending edge 114, a perpendicular side edge 118, and an angled side edge 116. A triangular side plate 120 in the form of a right triangle and having a face and an underside is provided adjacent the angled side edge 116. That is, the angled side edge 116 of the main body join the side plate 120 along a hypotenuse 124 of the side plate 120. A flat joining plate 130 extends in parallel with and joins the angle side edge 116 of the main body 110 and the hypotenuse 124 of the triangular side plate 120 defining a valley floor. The joining plate 130 has a face and an underside. The angled side plate 120 has a plurality of water recovery slots 142 which parallel the hypotenuse 124 of the plate 120. The main body 110 has a plurality of water recovery slots 144 which are aligned perpendicular to the laterally extending edges 112,114. The flat joining plate 130 has a plurality of longitudinally extending water recovery slots 146 along an upper portion of the valley floor and two laterally extending water recovery slots 147 in a lower portion of the valley floor.

A second aspect of the invention is an ice guide plate 100 as above wherein a valley gutter slot 148 is provided extending laterally across a lower end of the valley floor and extending along the short laterally extending edge 114 of the main body 110 and along one of the side edges 126 of the angled side plate 120.

A third aspect of the invention is an ice guide plate 100 as above wherein the underside of the joining plate 130 has a pair of downwardly extending drip ridges 156 which extend diagonally, laterally of a longitudinal axis of the joining plate section 130.

A fourth aspect of the invention is an ice guide plate as above, wherein the underside of the angled side plate 120 is provided with reinforcing ribs 152 molded therein extending in parallel with the two perpendicular sides 126 of the triangular plate 120, the underside of the main body 110 is provided with reinforcing ribs 154 molded therein extending in parallel with the laterally extending edges 112, 114 and perpendicular thereto, and the drip ridges 156 are formed as extensions of and joining two of the reinforcing ribs 152 of the adjacent angled side plate 120 and two of the reinforcing ribs 154 of the main body 110.

According to the present invention, the ice manufacturing member 74 arranged in the apparatus body 70 through the retaining member 76 is cooled down by the cooling unit 72 and then the ice pieces are manufactured on the ice manufacturing member 74. The thus manufactured ice pieces are released from the ice manufacturing member 74 and thereafter are guided by the guide plate 100 and stored in the ice bin. Because of the positioning of the two laterally extending water recovery slots 147 in the lower portion of the valley floor defined by the joining plate 130 and because the slots 147 extend primarily laterally, ice pieces being guided by the angled side plate 120 and by the inclined main body 110 are no longer trapped along the valley floor and continue to slide smoothly down to the ice bin. Further water is enabled to freely flow into the water tank below the guide plate 100.

Because of the valley gutter slot 148, water cannot accumulate at the base of the valley floor and overflow outside of the water tank. The extension of the valley gutter slot 148 up into both the angled side plate 120 and the main body 110 assists in directing the water flow down into the water tank without the necessity of a lower lip on the plate.

Because of the pair of downwardly extending drip ridges 156 on the underside of the joining plate 130, water flow is directed downwardly into the water tank and is no longer permitted by surface tension adhesion to flow along the entire underside of the joining plate 130 and outside of the water tank.

By making the drip ridges 156 formed as extensions of and joining two of the reinforcing ribs 152 of the adjacent angled side plate 120 and two of the reinforcing ribs 154 of the main body 110, surface tension adhesion flow of water is prevented and lateral strength reinforcement is added to the joining plate 130.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An ice guide plate comprising a trapezoidal main body having a face, an underside, a long laterally extending edge, a short parallel laterally extending edge, and an angled side edge, a triangular side plate in the form of a right triangle and having a face and an underside, the angled side edge of the main body joining the side plate along a hypotenuse of the side plate, and a flat joining plate which extends in parallel with and joins one angle side edge of the main body and the hypotenuse of the triangular side plate defining a valley floor, and having a face and an underside, wherein the angled side plate has a plurality of water recovery slots which parallel the hypotenuse of the plate, the main body has a plurality of water recovery slots which are aligned perpendicular to the laterally extending edges, and the flat joining plate has a plurality of longitudinally extending water recovery slots along an upper portion of the valley floor and two laterally extending water recovery slots in a lower portion of the valley floor.

2. The ice guide plate according to claim 1, wherein a valley gutter slot is provided extending laterally across a lower end of the valley floor and extending along the short laterally extending edge of the main body and along one of the side edges of the angled side plate.

3. An ice guide plate comprising a trapezoidal main body having a face, an underside, a long laterally extending edge, a short parallel laterally extending edge, and an angled side edge, a triangular side plate in the form of a right triangle and having a face and an underside, the angled side edge of the main body joining the side plate along a hypotenuse of the side plate, and a flat joining plate which extends in parallel with and joins one angle side edge of the main body and the hypotenuse of the triangular side plate defining a valley floor, the joining plate having a face and an underside, wherein the underside of the joining plate has a pair of downwardly extending drip ridges which extend diagonally, laterally of a longitudinal axis of the joining plate.

4. The ice guide plate according to claim 3, wherein the underside of the angled side plate is provided with reinforcing ribs molded therein extending in parallel with the two perpendicular sides of the triangle, the underside of the main body is provided with reinforcing ribs molded therein extending in parallel with the laterally extending edges and perpendicular thereto, and the drip ridges are formed as extensions of and joining two of the reinforcing ribs of the adjacent angled side plate and two of the reinforcing ribs of the main body.

5. The ice guide plate according to claim 3, wherein the angled side plate has a plurality of water recovery slots which parallel the hypotenuse of the plate, the main body has a plurality of water recovery slots which are aligned perpendicular to the laterally extending edges, and the flat joining plate has a plurality of longitudinally extending water recovery slots along an upper portion of the valley floor and two laterally extending water recovery slots in a lower portion of the valley floor.

6. The ice guide plate according to claim 4, wherein the angled side plate has a plurality of water recovery slots which parallel the hypotenuse of the plate, the main body has a plurality of water recovery slots which are aligned perpendicular to the laterally extending edges, and the flat joining plate has a plurality of longitudinally extending water recovery slots along an upper portion of the valley floor and two laterally extending water recovery slots in a lower portion of the valley floor.

7. The ice guide plate according to claim 5, wherein a valley gutter slot is provided extending laterally across a lower end of the valley floor and extending along the short laterally extending edge of the main body and along one of the side edges of the angled side plate.

8. The ice guide plate according to claim 6, wherein a valley gutter slot is provided extending laterally across a lower end of the valley floor and extending along the short laterally extending edge of the main body and along one of the side edges of the angled side plate.

* * * * *